US005077856A

United States Patent [19]

Freundl

[11] Patent Number: 5,077,856

[45] Date of Patent: Jan. 7, 1992

[54] LINT COLLECTION DEVICE

[76] Inventor: Elisabeth Freundl, Box 397, Duchess, Alberta, Canada

[21] Appl. No.: 627,955

[22] Filed: Dec. 17, 1990

[51] Int. Cl.[5] ..... A47L 13/08

[52] U.S. Cl. ..... 15/104 A; 15/111; 15/236.06

[58] Field of Search ..... 15/111, 236.06, 104 A

[56] References Cited

U.S. PATENT DOCUMENTS

| | | | |
|---|---|---|---|
| 916,725 | 3/1909 | Lafrentz | 15/236.06 X |
| 2,590,966 | 4/1952 | Heller | 15/236.06 X |
| 2,718,654 | 9/1955 | Draughn | 15/236.06 |
| 3,328,878 | 7/1964 | Engineer | 15/236.06 X |
| 3,421,170 | 1/1969 | Thomas | 15/104 A |

*Primary Examiner*—Chris K. Moore

[57] ABSTRACT

A manually-operated device for removing lint particles from a person's clothing. In one form of the invention the device includes a frame structure that mounts two parallel knife elements extending transverse to the motion axis of the frame structure. As the frame structure is moved over a fabric surface the cutter edges on the knife elements scrape against the fabric surface to uproot lint particles. The knife elements act as miniature shovel elements.

3 Claims, 1 Drawing Sheet

LINT COLLECTION DEVICE

BACKGROUND AND SUMMARY OF THE INVENTION

This invention relates to a device for removing lint particles from articles of clothing, e.g. a suit, sweater, dress, etc. In one form of the invention the lint-removal device comprises a frame structure having three straight-edged knife blades oriented one behind another to exert a scrapping action on the fabric surface as the frame structure is manually moved over that surface. Cutter edges on the knife blades act as miniature shovel elements to undercut lint particles on the fabric surface. The sharp cutter edges tend to cut into the lint particle threads so as to lock onto the threads, thereby pulling the threads along the fabric surface. Lint particles collect on the front faces of the knife elements.

It is known to remove lint from articles of clothing by utilizing a roller having a tacky (sticky) surface. U.S. Pat. No. 3,421,170 to F. Thomas, is representative of such roller-type lint-removal devices. I am not aware of any lint-removal devices using spaced knife blades adapted to exert a scrapping action on the fabric surface.

THE DRAWINGS

DESCRIPTION OF A PREFERRED EMBODIMENT OF THE INVENTION

Figure 1:
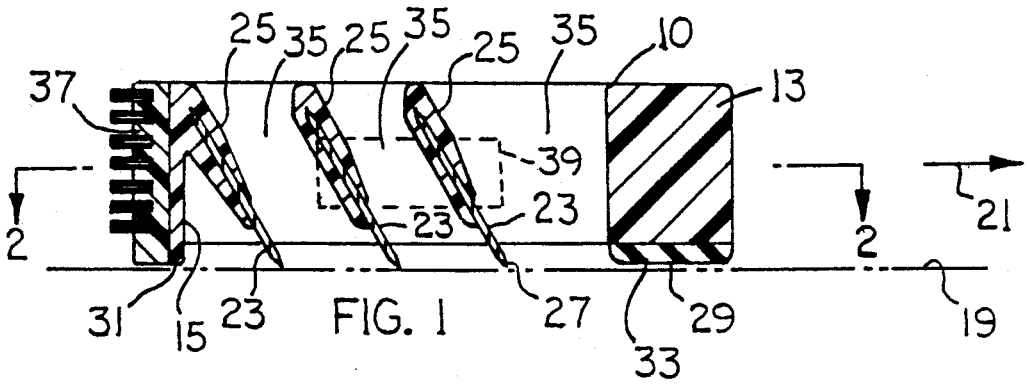
FIG. 1 is a sectional view through one embodiment of the invention, taken on line 1—1 in FIG. 2

The drawings show a manually-operated lint collector that includes a rectangular frame structure 10 preferably formed of a plastic material. The frame structure includes a leading frame element 13, a trailing frame element 15, and two side frame elements 17. In use of the lint collector frame structure 10 is moved over a fabric surface 19 in a left-to-right direction (FIG. 1) to remove lint particles from the fabric surface. Numeral 21 indicates the direction of movement of the frame structure. The movement axis 21 is located parallel to side frame elements 17.

The frame structure carries three knife elements 23 that extend transversely across the open space between the side frame elements 17. Each knife element can include two conventional razor blades arranged in end-to-end relationship within a slot formed in the lower edge of a transversely extending bar 25. Each bar 25 is integral with, or adhesively attached to, frame elements 17. The knife elements (razor edges) can be frictionally retained in the slots in bars 25, whereby the knife elements can be replaced should they break or wear out. Each knife element has a straight cutter edge 27 adapted to exert a scrapping action on the fabric surface as frame structure 10 is moved in a left-to-right direction.

Cutter edges 27 lie in a plane that may be slightly below an imaginary plane defined by the undersurfaces 29 and 31 of frame elements 13 and 15. Undersurfaces 29 and 31 can ride along the fabric surface to limit the pressure of cutter edges 27 on the fabric surface. Undersurface 29 is preferably formed by a strip 33 of soft elastomeric material; the soft elastomeric material grips the lint particles and pulls them out of frictional embedded contact with the fabric threads. The elastomeric material also tends to orient the lint particles in the direction of movement of frame structure 10, so that cutter edges 27 can cut into the lint particle surfaces for tearing such lint particles away from the fabric surface. Lint particles tend to accumulate on the front (advancing) faces of knife elements 23 for assimilation into spaces 35 formed between the knife blades.

Each knife element 23 is acutely angled to the motion plane of frame structure 10, as shown in FIG. 1, such that the cutter edge 27 of each knife element constitutes the leading edge of that knife element. The cutter edges act as miniature shovel elements to cut underneath at least some of the loosened particles lying on the fabric surface. The cutter edges scrape along the fabric surface to cut into the deeply embedded lint particles, thereby pulling them out of the fabric for collection by the next advancing cutter edge. The drawings show three knife elements, but a useful result can be obtained with only two knife elements.

Figure 2:
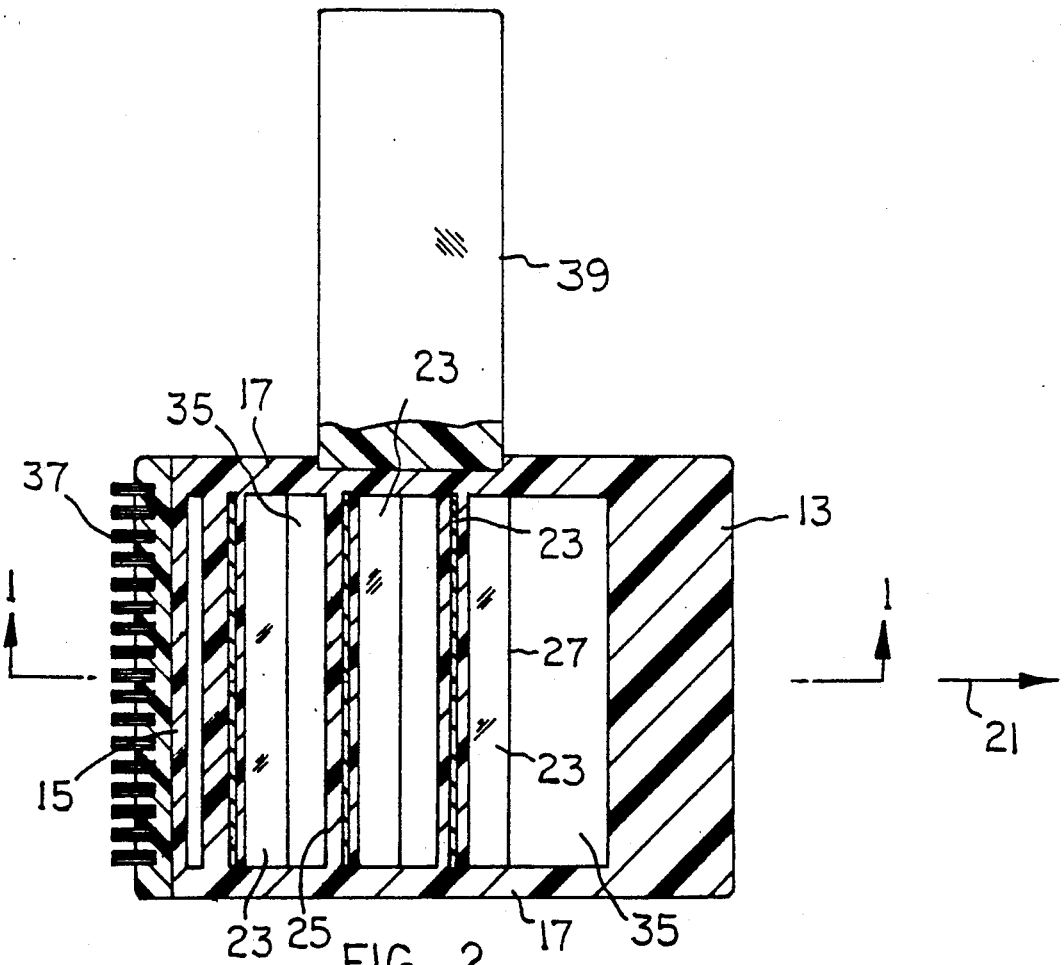
FIG. 2 is a sectional view taken on line 2—2 in FIG. 1.

The collected lint particles tend to combine together in rows of lint particles. Some of the rows of lint particles are carried into spaces 35. However, some of the rows of the particles remain loosely adhered to the fabric surface 19. In order to pick up these loosely adherred rows of particles a brush structure 37 is provided on frame element 15. In use, the frame structure is turned on end to enable the brush bristles to pick up the particles lying loosely on the fabric surface. Frame structure 10 can act as its own handle, in which case the person grips side frame elements 17 to advance the frame structure over the fabric surface. However, as shown in FIG. 2, an elongated handle 39 can be attached to the frame structure for manual manipulation of the lint collection device.

I claim:

1. A manually-operated lint collector, comprising a rigid hollow frame structure that includes a leading frame element, a trailing frame element, and two spaced side frame elements extending between the leading and trailing frame elements; said frame elements defining a central open space extending through the frame structure; said frame structure having a movement axis located parallel to the side frame elements; and at least two spaced parallel knife elements extending transversely across said open space with opposite ends of each knife element being located near the side frame elements; said knife elements having cutter edges thereof extending generally parallel to said leading frame element so that when the hollow frame structure is moved over a fabric surface along its movement axis the cutter edges will cut underneath line particles lying on the fabric surface; each knife element being acutely angled to the motion plane of the frame structure over the fabric surface, such that the cutter edge of each knife element constitutes the leading edge of that knife element; said leading frame element and said trailing frame element having undersurfaces in a common plane that is spaced only a slight distance above a common plane passing through the cutter edges, whereby said undersurfaces are adapted to ride on the fabric surface to limit the pressure of the knife element cutter edges on the fabric surface.

2. The lint collector of claim 1, wherein said undersurface of said leading frame element is formed by a strip of elastomeric material having the ability to grip lint particles on the fabric surface.

3. The lint collector of claim 2, and further comprising brush means extending outwardly from said trailing frame element for picking up particles lying loosely on the fabric surface.

* * * * *